US011389922B2

(12) United States Patent
Han et al.

(10) Patent No.: US 11,389,922 B2
(45) Date of Patent: Jul. 19, 2022

(54) POLISHING MEASUREMENT DEVICE AND ABRASION TIME CONTROLLING METHOD THEREOF, AND POLISHING CONTROL SYSTEM INCLUDING SAME

(71) Applicant: SK SILTRON CO., LTD., Gumi-si (KR)

(72) Inventors: Kee Yun Han, Gumi-si (KR); Suk Jin Jung, Gumi-si (KR)

(73) Assignee: SK Siltron Co., Ltd., Gumi-Si (KR)

( * ) Notice: Subject to any disclaimer, the term of this patent is extended or adjusted under 35 U.S.C. 154(b) by 1035 days.

(21) Appl. No.: 16/071,438

(22) PCT Filed: Jan. 11, 2017

(86) PCT No.: PCT/KR2017/000357
§ 371 (c)(1),
(2) Date: Jul. 19, 2018

(87) PCT Pub. No.: WO2018/026075
PCT Pub. Date: Feb. 8, 2018

(65) Prior Publication Data

US 2021/0205948 A1 Jul. 8, 2021

(30) Foreign Application Priority Data

Aug. 1, 2016 (KR) ..... 10-2016-0097788

(51) Int. Cl.
*B24B 37/013* (2012.01)
*B24B 49/02* (2006.01)
(Continued)

(52) U.S. Cl.
CPC ..... *B24B 37/013* (2013.01); *B24B 7/228* (2013.01); *B24B 37/042* (2013.01); *B24B 37/16* (2013.01);
(Continued)

(58) Field of Classification Search
USPC ..... 451/5, 10, 11, 41, 285, 287, 6
See application file for complete search history.

(56) References Cited

U.S. PATENT DOCUMENTS 9,555,517 B2 * 1/2017 Takahashi ..... B24B 49/00
2001/0012751 A1 8/2001 Boyd et al.
(Continued)

FOREIGN PATENT DOCUMENTS

CN 1447396 10/2003
CN 1484567 3/2004
(Continued)

OTHER PUBLICATIONS

International Search Report (with English Translation) and Written Opinion dated May 1, 2017 issued in Application No. PCT/KR2017/000357.
(Continued)

*Primary Examiner* — Eileen P Morgan
(74) *Attorney, Agent, or Firm* — Ked & Associates LLP

(57) ABSTRACT

The present embodiments provide a mechanism for computing a thickness of a scanned wafer shape to determine a profile, and computing a delta correction value and a polishing end point time by using a computed PV value by the profile and a set predicted PV value and reflecting the same on the polishing time of each wafer which is under polishing. Accordingly, excellent flatness of a wafer surface can be achieved and simultaneously, a plurality of controllers can be controlled simultaneously to reduce equipment cost.

17 Claims, 9 Drawing Sheets

(51) Int. Cl.

| | |
|---|---|
| ***B24B 49/04*** | (2006.01) |
| ***B24B 49/12*** | (2006.01) |
| ***B24B 37/16*** | (2012.01) |
| ***B24B 37/04*** | (2012.01) |
| ***B24B 7/22*** | (2006.01) |

(52) U.S. Cl.
CPC ..... *B24B 49/02* (2013.01); *B24B 49/04* (2013.01); *B24B 49/12* (2013.01)

(56) References Cited

U.S. PATENT DOCUMENTS

| | | | | |
|---|---|---|---|---|
| 2003/0068889 | A1 | 4/2003 | Kamada | |
| 2004/0195657 | A1 | 10/2004 | Miyashita et al. | |
| 2008/0071414 | A1* | 3/2008 | Fujita | B24B 37/013 700/121 |
| 2012/0026492 | A1* | 2/2012 | Zhang | H01L 22/26 356/300 |
| 2015/0017887 | A1 | 1/2015 | Kobayashi et al. | |

FOREIGN PATENT DOCUMENTS

| | | | | |
|---|---|---|---|---|
| CN | 1813340 | | 8/2006 | |
| CN | 1860584 | | 11/2006 | |
| CN | 1972780 | | 5/2007 | |
| CN | 102019572 | | 4/2011 | |
| CN | 102626895 | | 8/2012 | |
| CN | 102858495 | | 1/2013 | |
| CN | 104471685 | | 3/2015 | |
| CN | 104511838 | | 4/2015 | |
| CN | 105428229 | | 3/2016 | |
| CN | 105437076 | | 3/2016 | |
| CN | 105563301 | | 5/2016 | |
| CN | 105729294 | | 7/2016 | |
| CN | 105765707 | | 7/2016 | |
| CN | 105773398 | | 7/2016 | |
| JP | 2003-158108 | | 5/2003 | |
| JP | 2015-053438 | | 3/2015 | |
| KR | 10-2001-0108000 | | 12/2001 | |
| KR | 10-2005-0002801 | | 1/2005 | |
| KR | 10-1141075 | | 5/2012 | |
| KR | 101141075 | B1 * | 5/2012 | B24B 37/04 |
| KR | 10-2015-0007967 | | 1/2015 | |
| KR | 10-2016-0033033 | | 3/2016 | |
| WO | WO-9725660 | A1 * | 7/1997 | B24B 37/013 |
| WO | WO 2008/032753 | | 3/2008 | |
| WO | WO-2011139571 | A2 * | 11/2011 | B24B 37/005 |

OTHER PUBLICATIONS

Korean Office Action dated Nov. 8, 2017 issued in Application No. 10-2016-0097788.

Chinese Office Action dated Feb. 1, 2021 issued in Application No. 201780016931.2 (English translation attached).

Chinese Office Action dated Nov. 20, 2019 issued in Application No. 201780016931.2 (English translation attached).

Doyle, Keith B., "Integrated Optomechanical Analysis (Second Edition)" dated Jul. 30, 2015.

Chinese Office Action dated Aug. 5, 2020 issued in Application No. 201780016931.2 (English translation attached).

* cited by examiner

FIG. 4

| PROFILE | | POLISHING TIME | REMARK |
|---|---|---|---|
| | CONVEX SHAPE | 120~150% | Ref. 100% |
| | W SHAPE | 105~120% | |
| | M SHAPE | 95~80% | |
| | CONCAVE SHAPE | 80~60% | |

POLISHING MEASUREMENT DEVICE AND ABRASION TIME CONTROLLING METHOD THEREOF, AND POLISHING CONTROL SYSTEM INCLUDING SAME

CROSS-REFERENCE TO RELATED PATENT APPLICATIONS

This application is a U.S. National Stage Application under 35 U.S.C. § 371 of PCT Application No. PCT/KR2017/000357, filed Jan. 11, 2017, which claims priority to Korean Patent Application No. 10-2016-0097788, filed Aug. 1, 2016, whose entire disclosures are hereby incorporated by reference.

TECHNICAL FIELD

The present embodiments relate to a polishing measurement device and a abrasion time controlling method thereof, and a polishing control system including same, and more particularly to a polishing measurement device and a abrasion time controlling method thereof for enhancing the polishing precision (flatness) of a wafer surface, and a polishing control system including same.

BACKGROUND ART

A wafer, which becomes a substrate during fabricating a semiconductor is fabricated through an ingot growing process for growing an ingot used as a raw material, a slicing process for slicing an ingot into a wafer shape, a lapping process for uniformizing and planarizing a thickness of a wafer, an etching process for removing and mitigating an occurred damage, a polishing process for mirror-polishing a surface of a wafer, and a cleaning process for cleaning a wafer and removing foreign substances adhered to a surface.

During the above-described process, a defect may occur on a surface and subsurface of a wafer. Types of defects include particles, scratches, crystal defects, subsurface roughness, and the like.

Nowadays, restrictions on the above-described surface defects of a wafer are rapidly strengthened, and in particular, as the wafer has a large-scale diameter, it is required to implement a high-quality defect-free wafer due to a processing characteristic of the wafer of a large-scale diameter.

However, a conventional polishing apparatus cannot precisely apply a polishing time, and surface defects of the wafer still occurred.

For example, a thickness measuring apparatus of a wafer surface disclosed in Japanese Patent Application Laid-Open No. 2008-227393 is disposed in a support frame away from an upper surface plate of a polishing apparatus, measures a thickness of a wafer surface without being influenced by vibration of rotation of the upper surface plate, and applies a polishing time to the polishing apparatus according to the measured thickness of the wafer surface to polish the wafer surface.

However, in the related art, since one polishing apparatus is controlled by each controller for controlling the above-described thickness measuring apparatus, installation cost of the controller and the like is increased, and measurement accuracy of a thickness is lowered due to limitation of the number of measurements of the wafer and a processing environment of a slurry.

DISCLOSURE

Technical Problem

The present embodiments are directed to providing a polishing measurement device and a abrasion time controlling method thereof for computing a correction value according to a surface shape of a wafer and reflecting the correction value on a polishing end point time, and a polishing control system including same.

In addition, the present embodiments are directed to providing a polishing measurement device and a abrasion time controlling method thereof for applying a polishing end point time to a controller for each polishing apparatus, and a polishing control system including same.

Technical Solution

According to an embodiment, there is provided a polishing measurement device, including: a shape scan unit configured to scan a wafer shape provided from at least one controller controlling a polishing time of each wafer; a profile determination unit configured to compute a thickness of the scanned wafer shape to determine at least one profile for a wafer type; an end point time computation unit configured to compute a PV value by the determined profile and compute a delta correction value and a polishing end point time by using the computed PV value and a set predicted PV value; and a polishing time change unit configured to transmit the computed polishing end point time to the at least one controller to change a polishing time of each of the wafers which is under polishing.

The wafer shape may be a result generated according to the polishing time.

The profile determination unit may compute a thickness by location located on the same line of each of the wafers.

The thickness may include at least one of a maximum thickness, a minimum thickness, an average thickness, a ¼ thickness, a ⅔ thickness and a ¾ thickness of each of the wafers by location.

The at least one profile may include convex shape, W shape, M shape and concave shape distinguished on the basis of the computed thickness of the wafer shape.

The delta correction value may be the predicted PV value−the PV value, and the polishing end point time may be a control time according to the PV value+/−the delta correction value.

The predicted PV value may be a predicted value based on a predicted polishing time by the at least one profile or environmental factors affecting the polishing time.

According to an embodiment, there is provided a polishing control system, including: a polishing measurement device configured to compute a thickness of a scanned wafer shape to determine at least one profile for a wafer type, and compute a delta correction value and a polishing end point time by using a computed PV value by the determined profile and a set predicted PV value; at least one controller configured to apply a polishing time of each of the wafers to a following polishing apparatus to obtain a shape of the wafer which is under polishing, and change the polishing time to the computed polishing end point time; and the polishing apparatus configured to primarily polish a surface of each of the wafers according to the polishing time and secondarily polish the surface of each of the wafers according to the changed polishing end point time.

The polishing apparatus may compute a thickness by location of each of the wafers located on the same line.

The thickness may include at least one of a maximum thickness, a minimum thickness, an average thickness, a ¼ thickness, a ⅔ thickness and a ¾ thickness of each of the wafers by location.

The at least one profile may include convex shape, W shape, M shape and concave shape distinguished on the basis of the computed thickness of the wafer shape.

The delta correction value may be the predicted PV value−the PV value, and the polishing end point time may be a control time according to the PV value+/−the delta correction value.

The predicted PV value may be a predicted value based on a predicted polishing time by the at least one profile or environmental factors affecting the polishing time.

According to an embodiment, there is provided a abrasion time controlling method, as a method for controlling a polishing end point time for each wafer of a plurality of controllers by a polishing measurement device, including: scanning a wafer shape provided from at least one controller; computing a thickness by location located on the same line of each of the wafers based on the scanned wafer shape; determining at least one profile for a wafer type based on the computed thickness by location; computing a PV value by the determined profile, and computing a delta correction value and a polishing end point time by using the computed PV value and a set predicted PV value; and changing the polishing time of each of the wafers which is under polishing by transmitting the computed polishing end point time to the at least one controller.

The thickness may include at least one of a maximum thickness, a minimum thickness, an average thickness, a ¼ thickness, a ⅔ thickness and a ¾ thickness of each of the wafers by location.

The at least one profile may include convex shape, W shape, M shape and concave shape distinguished on the basis of the computed thickness of the wafer shape.

The delta correction value may be the predicted PV value−the PV value, and the polishing end point time may be a control time according to the PV value+/−the delta correction value.

The predicted PV value may be a predicted value based on a predicted polishing time by the at least one profile or environmental factors affecting the polishing time.

Advantageous Effects

As described above, in the present embodiments, a correction value for each profile of a wafer type may be computed and a polishing time may be changed, and thus excellent flatness of a wafer surface without defects on the wafer surface can be achieved.

In addition, in the present embodiments, a plurality of controllers may be controlled by one polishing measurement device, and thus equipment cost can be significantly reduced.

The advantageous effects are not limited thereto, and other effects not described may be clearly understood by those skilled in the art from the description below.

DESCRIPTION OF DRAWINGS

FIG. 4 is a configuration diagram illustrating an example of a profile obtained by a profile determination unit of the polishing measurement apparatus of FIG.

BEST MODE FOR CARRYING OUT THE INVENTION

Hereinafter, a method and controllers disclosed in the following embodiments of the present invention will be described in detail with reference to the drawings. Terms used herein is for the purpose of describing a specific embodiment only and is not intended to limit embodiments of the invention.

Also, terms such as "including", "having" or "configuring" described herein mean that components are present, unless specifically stated to the contrary, and thus should not be construed to exclude other components but to further include the other components.

Also, it is also to be understood that the singular form "the" used in the description of the embodiments disclosed in the following embodiments and claims are inclusive of plural expressions unless otherwise specified in the upper and lower contexts, and "and/or" should be understood to include any and all possible combinations of one or more of the related items listed.

In the following description of the embodiment, when it is described that each layer (film), region, pattern, or structure is formed "above/on" or "below/under" a substrate, each layer (film), region, pad or patterns, the description includes being formed both "directly" and "indirectly (by interposing another layer)" "above/on" or "below/under". Also, a standard of above/on or below/under of each layer will be described based on the drawings.

Hereinafter, a polishing measurement device and a control method for a polishing time thereof, and a polishing control system including same will be described in detail based on the above-described viewpoints.

Embodiment of Connection of Polishing Measurement Device

Figure 1:
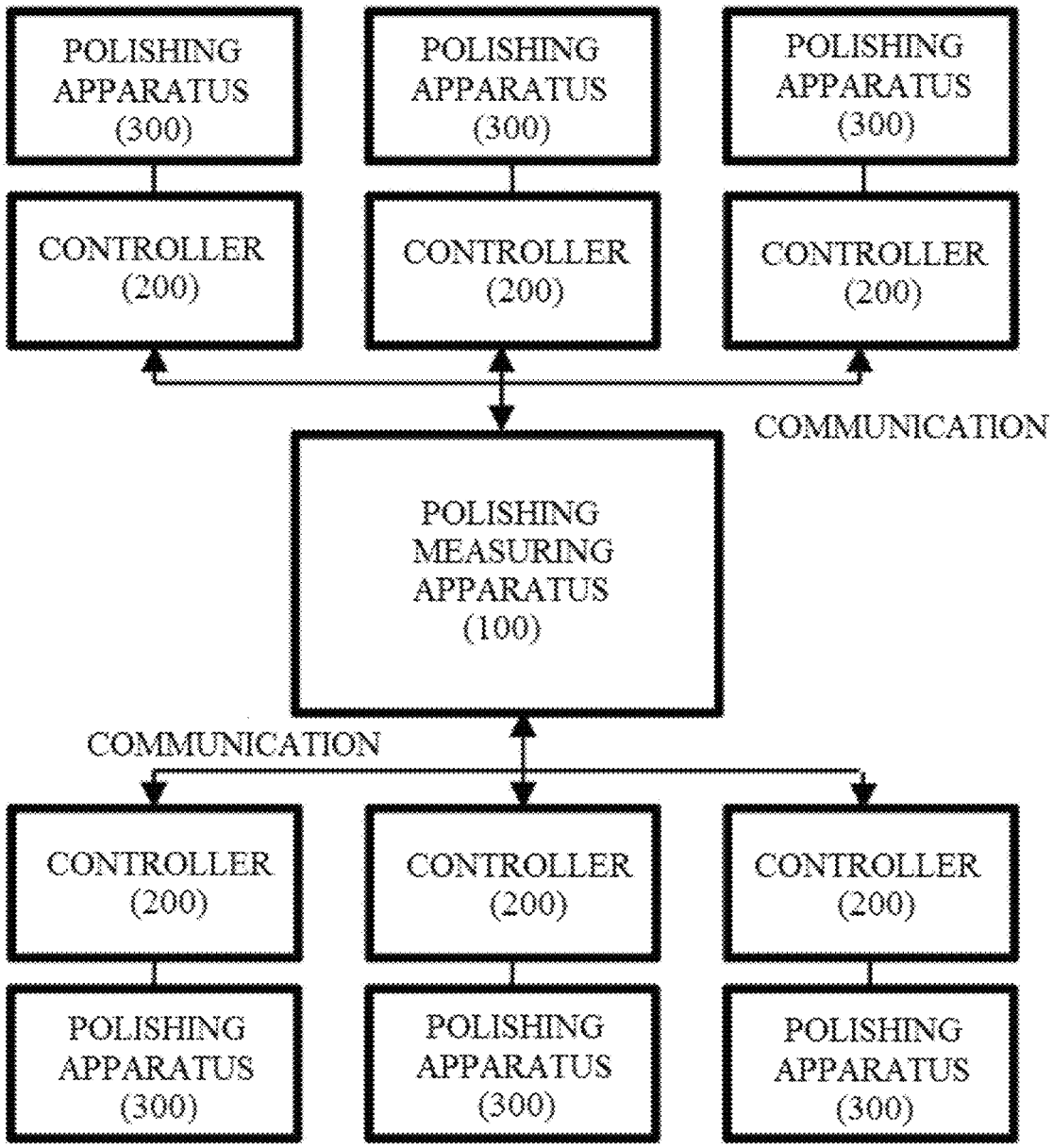
FIG. 1 is a block configuration diagram illustrating a connection relationship of a polishing measurement device according to an embodiment.

FIG. 1 is a block configuration diagram illustrating a connection relationship of a polishing measurement device according to an embodiment.

Referring to FIG. 1, a polishing measurement device 100 according to an embodiment controls at least one controller 200 by internal communication or external communication.

For example, the polishing measurement device 100 may control each controller 200 simultaneously by transmitting control commands related to a computed computation algorithm to each controller 200.

The above-described at least one controller 200 substantially applies the control commands related to the obtained computation algorithm to each of polishing apparatuses 300 connected by internal communication or external communication, and a wafer surface (a front surface and/or a rear surface) is polished in each polishing apparatus 300.

Such at least one controller 200 may be separately connected to each polishing apparatus 300, but may be disposed at inner portion of each polishing apparatus 300.

Hereinafter, the polishing measurement device 100 for deriving the above-described computation algorithm will be described in more detail.

Embodiment of Polishing Measurement Device

Figure 2:
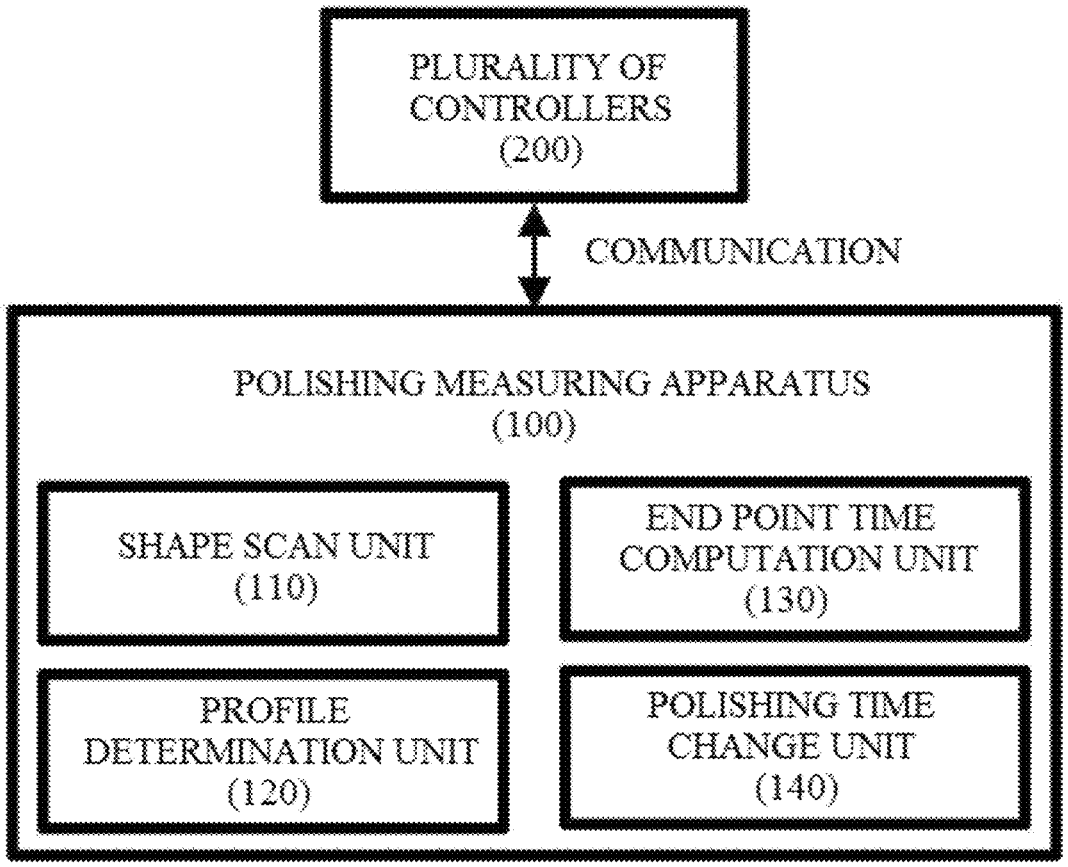
FIG. 2 is a block configuration diagram exemplarily illustrating an example of a polishing measurement device according to an embodiment.

FIG. 2 is a block configuration diagram exemplarily illustrating an example of a polishing measurement device according to an embodiment.

Figure 3:
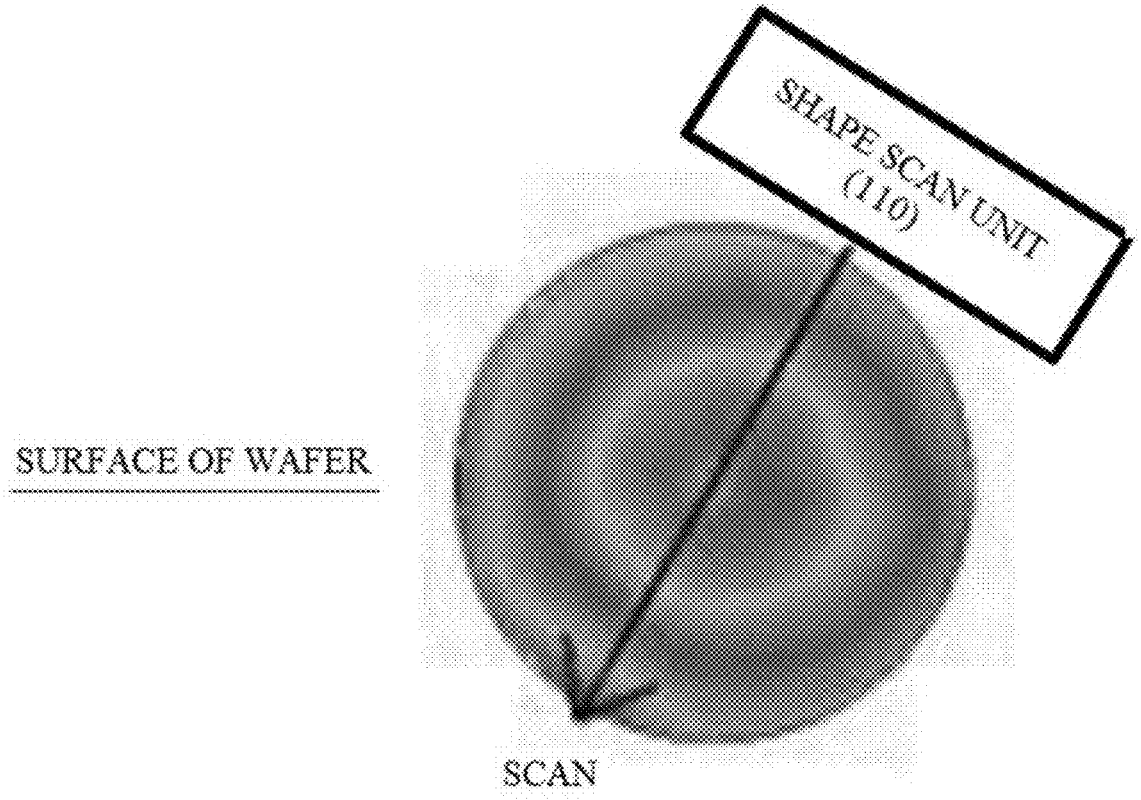
FIG. 3 is a configuration diagram illustrating an example of an operation of a shape scan unit disclosed in the polishing measurement device of FIG. 2.

In addition, FIG. 3 is a configuration diagram illustrating an example of an operation of a shape scan unit disclosed in the polishing measurement device of FIG. 2, FIG. 4 is a configuration diagram illustrating an example of a profile obtained by a profile determination unit of the polishing measurement apparatus of FIG. 2, and FIGS. 3 and 4 will be supplementarily referred to in describing FIG. 2.

Referring to FIG. 2, the polishing measurement device 100 according to an embodiment includes a shape scan unit 110, a profile determination unit 120, an end point time computation unit 130, and a polishing time change unit 140.

In an embodiment, the shape scan unit 110 may receive a wafer shape (wafer shape information) from at least one controller controlling a polishing time of each wafer, and may scan the received wafer shape.

Preferably, the shape scan unit 110 may perform a scan on a front surface and/or a rear surface of a wafer. For example, as shown in FIG. 3, the shape scan unit 110 may scan an entire front surface of the wafer when the shape scan unit 110 passes from a location corresponding to a center of the front surface of the wafer through the center of the front surface of the wafer toward an end. The above-described shape scan unit 110 may be provided in a polishing apparatus 300.

In an embodiment, the profile determination unit 120 may compute a thickness by each location for the wafer shape scanned by the shape scan unit 110. For example, the shape scan unit 110 may compute a thickness by each location point located on the same line of the wafer.

Since a wafer surface by location located on the same line has an arbitrary shape like a bumpy shape, it is possible to compute the thickness.

Here, the above-described thickness may include at least one of a maximum thickness, a minimum thickness, an average thickness, a ¼ thickness, a ¾ thickness and a ¾ thickness of a wafer surface of the wafer by location.

For example, when the arbitrary shape is bumpy, a highest height may be recognized and computed by the profile determination unit 120 as a maximum thickness, and a lowest height may be recognized by the profile determination unit 120 as a minimum thickness, and an average height therebetween may be recognized and computed by the profile determination unit 120 as an average thickness.

Likewise, when a ¼ thickness, a ¾ thickness and a ¾ thickness, which are the remaining thickness elements, are also divided into ¼, ¾ and ¾ from the center of the wafer surface, the thickness for each height may be computed by the profile determination unit 120.

Furthermore, the profile determination unit 120 according to an embodiment may determine at least one profile, which is profile information, related to a wafer type based on at least one computed thickness, which is thickness information.

In other words, when the profile determination unit 120 recognizes at least one thickness element by location of the wafer surface on the same line, the shape may be easily predicted, and based on this, it is possible to sufficiently recognize at least one profile shape for the wafer type by location of the wafer surface.

The above-described at least one profile may include convex shape, W shape, M shape and concave shape distinguished on the basis of at least one computed thickness of the wafer shape.

Such at least one profile shape may be illustrated as in FIG. 4. The convex shape shown in FIG. 4 requires a longer polishing time than the other types for planarization of the wafer surface, and then the polishing time may be shortened in the order of W shape, M shape and concave shape. However, the present invention is not limited to the above-described four types of the profile shape.

In an embodiment, the end point time computation unit 130 may compute a peak-to-valley value (PV value) by profile related to the four wafer shapes determined by the profile determination unit 120.

When the PV value is computed, it is possible to recognize an actual polishable time by each profile as shown in FIG. 4. However, even though a primary polishing time is computed and applied to the polishing of the actual wafer surface, the flatness of the wafer surface may not be easily implemented due to occurring errors.

In order to prevent this, the end point time computation unit 130 may set a predicted PV value in advance and utilize the PV value for planarization of the wafer surface. The above-described predicted PV value may be a predicted value based on a predicted polishing time by each of at least one profile and/or environmental factors affecting the polishing time.

Accordingly, the end point time computation unit 130 according to an embodiment may compute a delta correction value capable of reducing an error by using the computed PV value and the set predictive PV value, and may compute the polishing end point time to be applied to the polishing of the wafer surface by each profile by using the computed delta correction value.

For example, a delta correction value D may be obtained by an operation of the following Equation 1, and a polishing end point time T may be computed by using the delta correction value D that has already been obtained and a control time t computed according to each PV value.

That is, the end point time computation unit 130 may compute the polishing end point time T by the following Equation 2. As the above-described PV value is lower, the flatness (global flatness values (GBIR)) of the wafer surface is better, so that the control time t may be determined according to the PV value.

$$\text{Delta correction value } D = \text{Predicted } PV \text{ value} - PV \text{ value} \quad \text{[Equation 1]}$$

$$\text{The polishing end point time } T \text{ is the control time } t \text{ according to the } PV \text{ value} \pm \text{the delta correction value } D \quad \text{[Equation 2]}$$

Finally, in an embodiment, the polishing time change unit 140 may transmit the polishing end point time T computed by the end point time computation unit 130 to at least one controller 200 connected by internal communication or external communication.

As described above, since the computed polishing end point time T is transmitted to each controller 200, the polishing end point time T obtained by each controller 200 may be different. Accordingly, the polishing measurement device 100 according to an embodiment may simultaneously control at least one controller 200 by transmitting an algorithm computed for each controller 200 to a corresponding controller 200.

However, the conventional apparatus neither applies the above-described computation algorithm, nor provides a mechanism for controlling each controller 200 simultaneously.

The at least one controller 200 receiving the polishing end point time T may change the polishing time of each wafer which is under primary polishing according to the obtained polishing end point time.

That is, the at least one controller 200 may change the primary polishing time to the polishing end point time which is a secondary polishing time, and apply to each polishing apparatus 300. Accordingly, each polishing apparatus 300 perform the polishing of the wafer surface according to the changed secondary polishing end point time.

As described above, in the present embodiment, the correction value by each profile of the wafer type is computed and the polishing time is changed and applied, so that excellent flatness may be implemented on the surface of the wafer without defects on the wafer surface and a plurality of controllers may be simultaneously controlled, and thus equipment cost can be significantly reduced.

Embodiment of Polishing Control System

Figure 5:
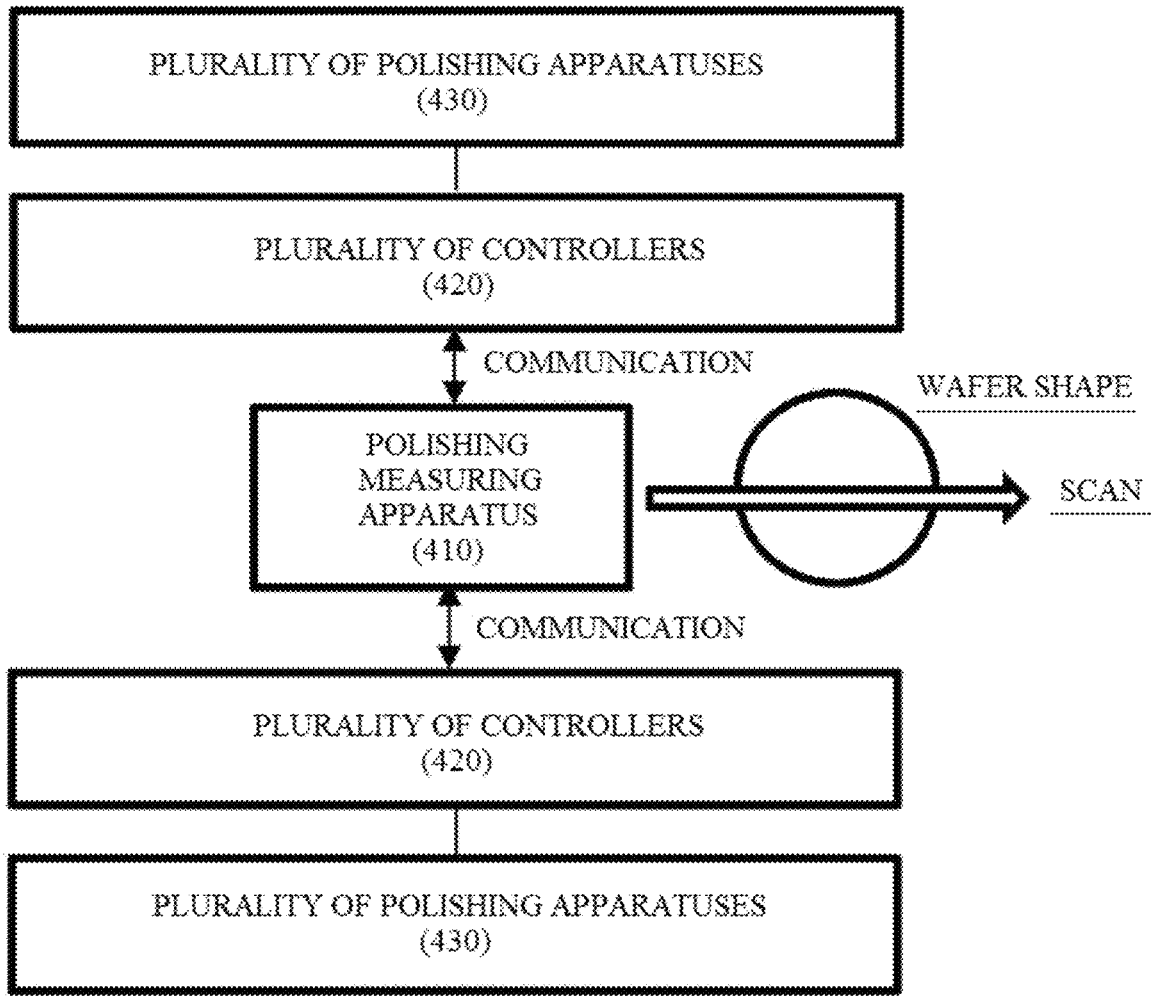
FIG. 5 is a block configuration diagram exemplarily illustrating an example of a polishing control system according to an embodiment.

FIG. 5 is a block configuration diagram exemplarily illustrating an example of a polishing control system according to an embodiment.

Referring to FIG. 5, a polishing control system 400 according to an embodiment includes a polishing measurement device 410, a controller 420, and a polishing apparatus 430.

In an embodiment, the polishing measurement device 410 is connected to a plurality of controllers 420 by internal communication or external communication, respectively, and performs each algorithm for planarizing a surface of a wafer to apply to each controller 420.

The internal communication or the external communication is a generally known connection, and thus a description thereof will be omitted.

In an embodiment, the controller 420 is disposed one by one for each polishing apparatus 430 and substantially controls the polishing apparatus 430, and each polishing apparatus 430 may be controlled according to a control command (control command by the computation algorithm) of the polishing measurement device 410.

Further, when the controller 420 applies a polishing time provided from the polishing measurement device 410 to each polishing apparatus 430, each polishing apparatus 430 may primarily polish the surface of each wafer (including the front and rear surfaces of the wafer) according to the polishing time.

Furthermore, the controller 420 obtains the shape (shape information) of each polished wafer according to the primary polishing time from each polishing apparatus 430, and may transmit to one polishing measurement device 410 by the internal communication or the external communication.

The internal communication or the external communication, which is a means of connection between each of the above-described components, is a generally known connection, and thus a description thereof will be omitted.

Accordingly, the polishing measurement device 410 according to an embodiment may generate the above-described computation algorithm based on the shape of each wafer received from the plurality of controllers 420, and transmit the polishing end point time included in the generated computation algorithm to each controller 420.

Each controller 420 may apply the obtained polishing end point time to each polishing apparatus 430 to change the polishing time which is under polishing, and each polishing apparatus 430 may perform secondary polishing for the wafer surface based on the changed polishing end point time.

Meanwhile, one controller 420 may be connected to each polishing apparatus 300 by the internal or the external communication, but may be disposed inside thereof as one component of each of the polishing apparatuses 300.

Hereinafter, the polishing measurement device 410 for generating the above-described computation algorithm will be described in more detail.

Detailed Embodiment of Polishing Measurement Device

Figure 6:
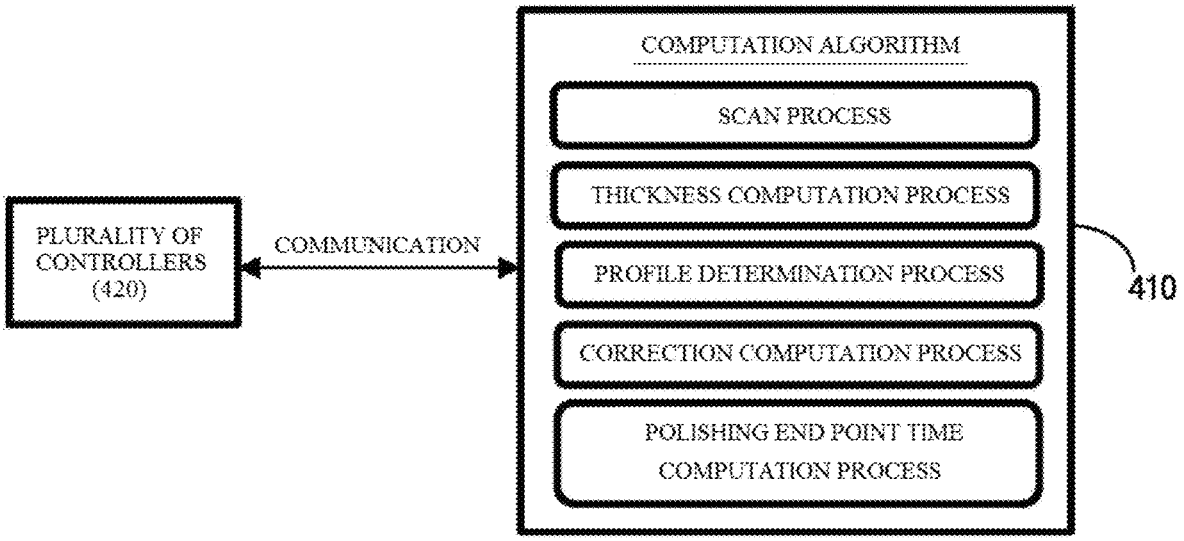
FIG. 6 is a block configuration diagram exemplarily illustrating an example of a polishing measurement device according to an embodiment.

FIG. 6 is a block configuration diagram exemplarily illustrating an example of a polishing measurement device according to an embodiment. The above-described FIGS. 3 and 4 will be supplementarily referred to in describing FIG. 6.

Referring to FIG. 6, the polishing measurement device 410 according to an embodiment may receive a wafer shape (wafer shape information) from at least one controller controlling a polishing time of each wafer, and may scan the received wafer shape.

Preferably, the polishing measurement device 410 may perform a scan on a front surface and/or a rear surface of the wafer. For example, as shown in FIG. 3, the polishing measurement device 410 may scan an entire front surface of the wafer when passing from a location corresponding to a center of the front surface of the wafer through the center of the front surface of the wafer toward an end.

Furthermore, the polishing measurement device 410 may compute a thickness by each location for the wafer shape that has already been scanned. The polishing measurement device 410 may compute a thickness by each location point located on the same line of the wafer.

Since the wafer surface by location located on the same line has an arbitrary shape like a bumpy shape, it is possible to compute the thickness.

Here, the above-described thickness may include at least one of a maximum thickness, a minimum thickness, an average thickness, a ¼ thickness, a ⅔ thickness and a ¾ thickness of a wafer surface of the wafer by location.

For example, when an arbitrary shape is bumpy, a highest height in the arbitrary shape may be used as a maximum thickness, and a lowest height may be used as a minimum thickness, and an average height therebetween may be used as an average thickness.

Likewise, when dividing into ¼, ⅔, and ¾ from the center of the arbitrary shape, each height may be used in ¼, ⅔, and ¾ thicknesses.

Furthermore, the polishing measurement device 410 may determine at least one profile (profile information) related to a wafer type based on at least one computed thickness (thickness information).

More specifically, when the polishing measurement device 410 recognizes at least one thickness element by location of the wafer surface on the same line, the shape may be easily predicted, and based on this, it is possible to sufficiently recognize at least one profile shape for the wafer type by location of the wafer surface.

The above-described at least one profile may include convex shape, W shape, M shape and concave shape distinguished on the basis of at least one computed thickness of the wafer shape as shown in FIG. 3.

Such at least one profile shape may be illustrated as in FIG. 4. The convex shape shown in FIG. 4 requires a longer polishing time than the other types for planarization of the wafer surface, and then the polishing time may be shortened in the order of W shape, M shape and concave shape. However, the present invention is not limited to the above-described four types of the profile shape.

In an embodiment, the polishing measurement device 410 may compute a peak-to-valley value (PV value) by profile related to the four determined wafer shapes.

When the PV value is computed, it is possible to recognize an actual polishable time by each profile as shown in FIG. 4. However, even though a primary polishing time is computed and applied to the polishing of the actual wafer surface, the flatness of the wafer surface may not be easily implemented due to occurring errors.

In order to prevent this, the polishing measurement device 410 may set a predicted PV value in advance and utilize the PV value for planarization of the wafer surface. The above-described predicted PV value may be a predicted value based on a predicted polishing time by each of at least one profile and/or environmental factors affecting the polishing time.

Accordingly, the polishing measurement device 410 may compute a delta correction value capable of reducing an error by using the computed PV value and the set predictive PV value, and may compute the polishing end point time to be applied to the polishing of the wafer surface by each profile by using the computed delta correction value.

For example, a delta correction value D may be obtained by an operation of the following Equation 3, and a polishing end point time T may be computed by using the delta correction value D that has already been obtained and a control time t computed according to each PV value.

That is, the polishing measurement device 410 may compute the polishing end point time T by the following Equation 4. As the above-described PV value is lower, the flatness (global flatness values (GBIR)) of the wafer surface is better, so that the control time t may be determined according to the PV value.

$$\text{Delta correction value } D = \text{Predicted } PV \text{ value} - PV \text{ value} \quad \text{[Equation 3]}$$

$$\text{The polishing end point time } T \text{ is the control time } t \text{ according to the } PV \text{ value} \pm \text{the delta correction value } D \quad \text{[Equation 4]}$$

In an embodiment, the polishing measurement device 410 may transmit the polishing end point time T that has been already computed to at least one controller 420 connected by the internal communication or the external communication.

As described above, since the computed polishing end point time T is transmitted to each controller 420, the polishing end point time T obtained by each controller 420 may be different. Accordingly, the polishing measurement device 410 according to an embodiment may simultaneously control at least one controller 420 by transmitting the algorithm computed for each controller 420 to a corresponding controller 420.

However, the conventional apparatus neither applies the above-described computation algorithm, nor provides a mechanism for controlling each controller 420 simultaneously.

The at least one controller 420 receiving the polishing end point time T may change the polishing time of each wafer which is under primary polishing according to the polishing end point time that has already been obtained.

That is, the at least one controller 420 may change the primary polishing time to the polishing end point time which is a secondary polishing time, and apply to each polishing apparatus 430. Accordingly, each polishing apparatus 430 performs the polishing for the wafer surface according to the changed secondary polishing end point time.

As described above, in the present embodiment, the correction value by each profile of the wafer type is computed and the polishing time is changed and applied, so that excellent flatness may be implemented on the surface of the wafer without defects on the wafer surface and a plurality of controllers may be simultaneously controlled, and thus equipment cost can be significantly reduced.

Embodiment of Control Method for Polishing Time

Figure 7:
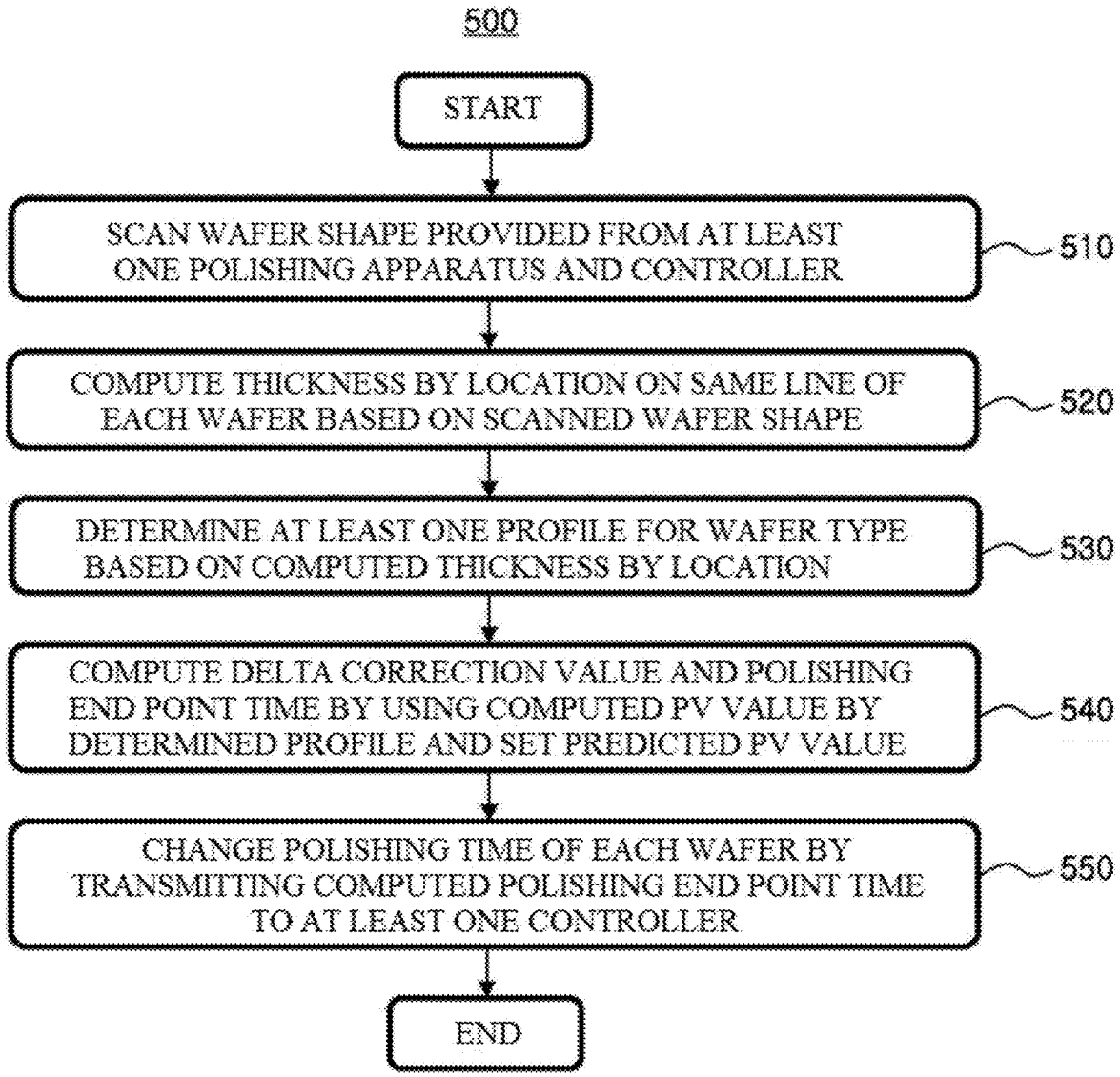
FIG. 7 is a flowchart exemplarily illustrating an example of a abrasion time controlling method according to an embodiment.

FIG. 7 is a flowchart exemplarily illustrating an example of a abrasion time controlling method according to an embodiment.

The abrasion time controlling method 500 according to an embodiment controls a primary polishing time and a secondary polishing time for each wafer of a plurality of controllers by a polishing measurement device.

Here, the primary polishing time refers to a time for primary polishing of each wafer surface (for example, including the front and rear surfaces), and the above-described secondary polishing time is a time for which the primary polishing time is corrected, which may refer to a time for polishing again for each wafer surface polished once.

Since the above-described polishing measurement device has been described in FIGS. 1 to 6, a description thereof will be omitted, but is also applied in the present embodiment. However, in the present embodiment, only an entire configuration or a part of the configuration of the polishing measurement device of FIGS. 1 to 6 may be implemented.

The method for controlling the polishing time 500 implemented by the above-described polishing measurement device is as follows.

Referring to FIG. 7, the method for controlling the polishing time 500 according to an embodiment includes steps 510 to 550 for performing planarization of a wafer surface by the polishing measurement device.

Firstly, in an exemplary step 510, the polishing measurement device may scan a wafer shape (shape information of a wafer) provided from at least one controller. The wafer shape may be shape information of the primarily processed wafer.

In an exemplary step 520, the polishing measurement device may compute a thickness by location located on the same line of each wafer based on the wafer shape that has already been scanned.

The thickness used in the computation may include at least one of a maximum thickness, a minimum thickness, an average thickness, a ¼ thickness, a ¾ thickness and a ¾ thickness of each of the wafers by location located on the same line. Such an example has been fully discussed in FIG. 3 and may also be applied to the present embodiment.

In an exemplary step 530, the polishing measurement device may determine at least one profile related to a wafer type based on the thickness by location of the wafer surface that has been already computed.

For example, the above-described at least one profile may include convex shape, W shape, M shape and concave shape distinguished on the basis of the computed thickness of the wafer shape. Such an example has been fully discussed in FIG. 4 and may also be applied to the present embodiment.

In an exemplary step 540, the polishing measurement device may compute a PV value by each profile that has already been determined, and may compute a delta correction value and a polishing end point time by using the computed PV value and a set predicted PV value.

The above-described delta correction value may refer to the predicted PV value−the PV value, the polishing end point time may refer to a control time according to the PV value that has already been computed±the delta correction value, and the predicted PV value may be a predicted value based on a predicted polishing time by each of at least one profile or environmental factors affecting the polishing time.

Finally, in an exemplary step 550, the polishing measurement device may transfer the polishing end point time that has already been computed to at least one controller to change the polishing time of each wafer which is under polishing.

For example, at least one controller may change the primary polishing time to the polishing end point time which is the secondary polishing time, and apply to each polishing apparatus. Accordingly, each polishing apparatus performs the polishing for the wafer surface according to the changed secondary polishing end point time.

As described above, in the present embodiment, the correction value by each profile of the wafer type is computed and the polishing time is changed and applied, so that excellent flatness may be implemented on the surface of the wafer without defects on the wafer surface and a plurality of controllers may be simultaneously controlled, and thus equipment cost can be significantly reduced.

Meanwhile, the above-described predicted PV value, the delta correction value, and/or the polishing end point time may be a value set according to, for example, the profile shape of four wafer types, but a computation result may vary. Hereinafter, it will be described in more detail.

Embodiment of Correlation Between Gap and Wafer Thickness/Profile

Figure 8:
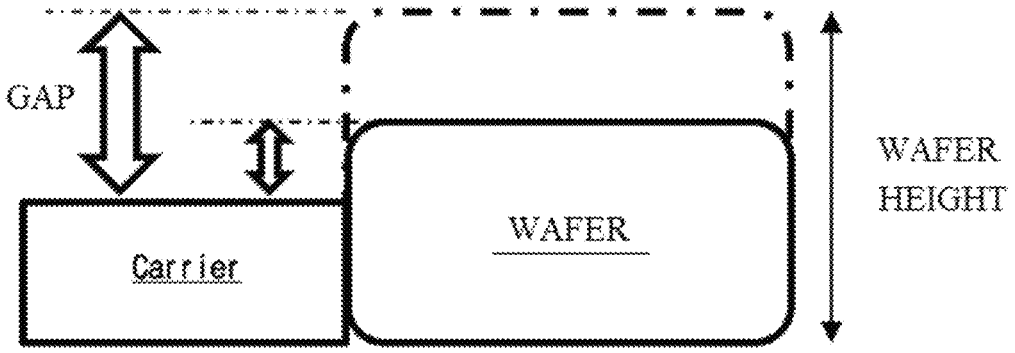
FIG. 8 is a diagram schematically illustrating a correlation between a wafer shape and a gap according to an embodiment.
Figure 9:
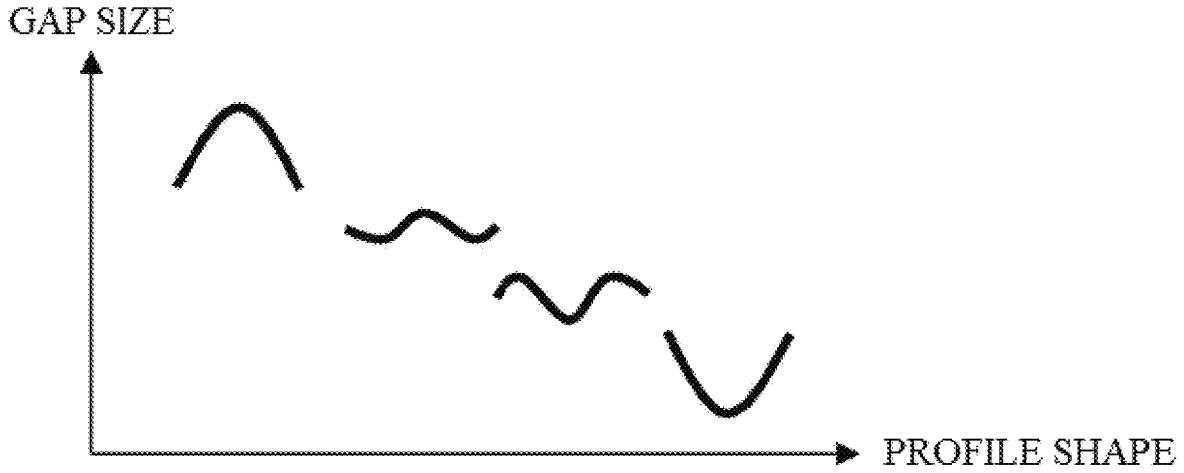
FIG. 9 is a graph schematically illustrating a correlation between a wafer-like profile shape and a gap.

FIG. 8 is a diagram schematically illustrating a correlation between a wafer shape and a gap according to an embodiment, and FIG. 9 is a graph schematically illustrating a correlation between a wafer-like profile shape and a gap.

The polishing measurement device described in FIGS. 1 to 7 may set a predicted PV value so as to increase or decrease a polishing time according to a profile shape (shape of a wafer surface) of, for example, four types of wafers for planarization of the wafer surface, and may compute a polishing end point time.

For example, a wafer-like dotted line shown in FIG. 8 is the wafer shape when the polishing time is short, and as a gap between the height of wafer shape of the dotted line and the carrier is large, the edge shape of the wafer is also highly roll-off, so that it may have a convex shape profile shape.

In the case of the convex shape profile shape, when the polishing time is increased, the convex shape profile shape becomes a wafer shape of a solid line, the gap between the height of the wafer shape of the solid line and the carrier is reduced correspondingly, and the roll-off of the edge shape of the wafer also decreases. When a correlation of such a gap is applied to a profile type, it can be expressed as shown in FIG. 9.

The convex shape profile type shown in FIG. 9 has the largest difference in gap, and the difference in gap is smaller in the order of in the profile shapes of the W shape, M shape and concave shape.

Accordingly, in the polishing measurement device described in FIGS. 1 to 7, when the profile shape of the wafer is a convex shape, the polishing end point time is increased so as to be a concave shape, and as the center polishing amount of the wafer surface increases, a predicted PV value etc. may be set in a direction approaching to flatness, and the profile shape of the rest of W shape, M shape and concave shape may also set the predicted PV value etc. in the direction approaching to the flatness in consideration of the gap difference in FIG. 8.

Accordingly, in the embodiments of FIGS. 1 to 7, the delta correction value and the polishing end point time reflecting the predicted PV value etc. described above may contribute greatly to achieve the flatness of the wafer surface.

It will be obvious to those skilled in the art that the present embodiments disclosed above may be embodied in other specific forms without departing from the spirit or essential characteristics thereof.

Accordingly, the above detailed description should not be construed restrictively in all aspects and should be regarded as illustrative. The scope of the present embodiment should be determined by reasonable interpretation of the appended claims, and all changes within the equivalent scope of the present embodiment are included in the scope of the present embodiment.

MODES OF THE INVENTION

The mode for carrying out the invention has been fully described in the foregoing "Best Mode for Carrying out the Invention".

INDUSTRIAL APPLICABILITY

The above-described polishing measurement device and the method for controlling the polishing time thereof, and the polishing control system including same may compute a correction value according to a surface shape of a wafer and reflect the same on the polishing end point time, and apply the polishing end point time to a controller for each polishing apparatus. Therefore, it is possible to apply to a wafer fabricating apparatus capable of fabricating a wafer having excellent flatness without defects on a wafer surface.

The invention claimed is:

1. A polishing measurement device comprising:

a scanner configured to scan a wafer shape provided from at least one controller controlling a polishing time of each wafer;

a profile determination processor configured to compute a thickness of the scanned wafer shape and to determine at least one profile related to a wafer type based on the computed thickness;

an end point time computation processor configured to compute a peak-to-valley (PV) value by the determined profile and to compute a delta correction value and a polishing end point time by using the computed PV value and a set predicted PV value; and a polishing time change processor configured to transmit the computed polishing end point time to the at least one controller so as to change a polishing time of each of the wafers which is under polishing, and wherein the scanner is configured to scan an entire front surface of the wafer when the scanner passes from a location corresponding to a center of the front surface of the wafer through the center of the front surface of the wafer toward an end, and wherein the delta correction value is the predicted PV value−the PV value, and the polishing end point time is a control time according to the PV value+/−the delta correction value.

2. The polishing measurement device of claim 1, wherein the wafer shape is a result generated according to the polishing time.

3. The polishing measurement device of claim 1, wherein the profile determination processor is configured to compute a thickness by location located on the same line of each of the wafers.

4. The polishing measurement device of claim 3, wherein the thickness includes at least one of a maximum thickness, a minimum thickness, an average thickness, a ¼ thickness, a ⅔ thickness and a ¾ thickness of each of the wafers by location.

5. The polishing measurement device of claim 4, wherein the at least one profile includes a convex shape, a W shape, an M shape and a concave shape distinguished based on the computed thickness of the wafer shape.

6. The polishing measurement device of claim 1, wherein the predicted PV value is a predicted value based on a predicted polishing time by the at least one profile or environmental factors affecting the polishing time.

7. The polishing measurement device of claim 1, wherein the polishing time change processor is configured to transmit a polishing end point time computed by the end point time computation processor to at least one controller connected by internal communication or by external communication.

8. The polishing measurement device of claim 7, wherein the at least one controller receiving the polishing end point time changes a polishing time of each wafer which is under primary polishing according to the obtained polishing end point time.

9. A polishing control system, comprising:

a polishing measurement device configured to compute a thickness of a scanned wafer shape and to determine at least one profile related to a wafer type based on the computed thickness, and to compute a delta correction value and a polishing end point time by using a computed peak-to-valley (PV) value by the determined profile and a set predicted PV value;

at least one controller configured to apply a polishing time of each of the wafers to a following polishing apparatus so as to obtain a shape of the wafer which is under polishing, and to change the polishing time to the computed polishing end point time; and the polishing apparatus is configured to primarily polish a surface of each of the wafers according to the polishing time and to secondarily polish the surface of each of the wafers according to the changed polishing end point time, wherein the polishing measurement device includes a scanner configured to scan an entire front surface of the wafer when the scanner passes from a location corresponding to a center of the front surface of the wafer through the center of the front surface of the wafer toward an end, and wherein the delta correction value is the predicted PV value−the PV value, and the polishing end point time is a control time according to the PV value+/−the delta correction value.

10. The polishing control system of claim 9, wherein the polishing measurement device is configured to compute a thickness by location of each of the wafers located on a same line.

11. The polishing control system of claim 10, wherein the thickness includes at least one of a maximum thickness, a minimum thickness, an average thickness, a ¼ thickness, a ⅔ thickness and a ¾ thickness of each of the wafers by location.

12. The polishing control system of claim 11, wherein the at least one profile includes a convex shape, a W shape, an M shape and a concave shape distinguished based the computed thickness of the wafer shape.

13. The polishing control system of claim 9, wherein the predicted PV value is a predicted value based on a predicted polishing time by the at least one profile or environmental factors affecting the polishing time.

14. An abrasion time controlling method, as a method for controlling a polishing end point time for each wafer of a plurality of controllers by a polishing measurement device, comprising:

scanning a wafer shape provided from at least one controller;

computing a thickness by location located on a same line of each of the wafers based on the scanned wafer shape;

determining at least one profile related to a wafer type based on the computed thickness by location;

computing a peak-to-valley (PV) value by the determined profile, and computing a delta correction value and a polishing end point time by using the computed PV value and a set predicted PV value; and changing the polishing time of each of the wafers which is under polishing by transmitting the computed polishing end point time to the at least one controller, wherein the scanning of the wafer shape includes scanning an entire front surface of the wafer when a scanner passes from a location corresponding to a center of the front surface of the wafer through the center of the front surface of the wafer toward an end, and wherein the delta correction value is the predicted PV value−the PV value, and the polishing end point time is a control time according to the PV value+/−the delta correction value.

15. The abrasion time controlling method of claim 14, wherein the thickness includes at least one of a maximum thickness, a minimum thickness, an average thickness, a ¼ thickness, a ⅔ thickness and a ¾ thickness of each of the wafers by location.

16. The abrasion time controlling method of claim 15, wherein the at least one profile includes a convex shape, a W shape, an M shape and a concave shape distinguished based on the computed thickness of the wafer shape.

17. The abrasion time controlling method of claim 14, wherein the predicted PV value is a predicted value based on a predicted polishing time by the at least one profile or environmental factors affecting the polishing time.

* * * * *